US005829569A

United States Patent [19]

Cheng et al.

[11] Patent Number: 5,829,569

[45] Date of Patent: Nov. 3, 1998

[54] COIN RECEPTION MECHANISM

[75] Inventors: Li-Te Cheng; Sung-Min Lin, both of Taipei, Taiwan

[73] Assignee: Karin Telecomm Corporation, Taipei, Taiwan

[21] Appl. No.: 759,786

[22] Filed: Dec. 3, 1996

[51] Int. Cl.[6] ..... G07F 1/04

[52] U.S. Cl. ..... 194/345; 194/347

[58] Field of Search ..... 194/321, 323, 194/345, 347, 348, 349

[56] References Cited

U.S. PATENT DOCUMENTS

| | | | |
|---|---|---|---|
| 5,088,587 | 2/1992 | Goodrich et al. | 194/347 X |
| 5,299,673 | 4/1994 | Wu | 14/345 |
| 5,513,738 | 5/1996 | Hird et al. | 194/347 X |
| 5,596,630 | 1/1997 | Hsu | 194/345 X |

*Primary Examiner*—F. J. Bartuska
*Attorney, Agent, or Firm*—Christensen O'Connor Johnson & Kindness PLLC

[57] ABSTRACT

A coin reception mechanism includes a base fixed inside for example a pay phone to receive coins for operating the pay phone. The coin reception mechanism includes a chute assembly including a first plate and a second plate which are independent of each other and are both pivoted to the base in such a manner to form a spacing therebetween defining a coin chute leading to a coin collector container. The first plate has a coin slot formed thereon to be substantially in alignment with the coin chute for receiving and guiding a coin into the coin chute. An actuator is pivoted to the base and has two driving arms in contact engagement with the first plate and a link connecting to the second plate so that when the actuator is rotated to drive the first and second plates with respect to the base, the first plate is rotated by the arms of the actuator through a first angular displacement and the second plate is rotated by the link through a second angular displacement which is greater than the first angular displacement so that the first plate is angularly displaced from the second plate to define an opening therebetween for removing an odd matter located in the coin chute out of the chute. A user actuateable lever is provided to rotate the actuator by the user for removal of the odd matter.

5 Claims, 4 Drawing Sheets

COIN RECEPTION MECHANISM

FIELD OF THE INVENTION

The present invention relates to a coin reception mechanism, such as that used in a pay phone, and in particular to such a coin reception mechanism having an odd matter or debris removing device.

BACKGROUND OF THE INVENTION

Pay phones, slot machines and video game machines all include a coin reception mechanism having a coin slot to receive coin therein for starting these machines. Quite often, it is found that odd matters are forcibly inserted into the coin slot and thus blocking the coin slot which makes the machine incapable to be operated for no coin can be received and detected. Conventionally, the odd matters have to be removed by disassembling the machine. This is quite a time-and labor-consuming job. The cost of maintenance is thus increased.

It is thus desirable to provide a coin reception mechanism which comprises an odd matter removing device so that the odd matter and/or debris located in the coin slot or coin chute guiding the coin to a collector container may be readily removed without disassembling the machine.

SUMMARY OF THE INVENTION

The principal object of the present invention is to provide a coin reception mechanism which comprises a coin chute formed by separable members which are actuated to move through different displacement for separating from each other so as to allow the odd matter and/or debris to be readily removed out of the coin chute without disassembling the coin reception mechanism.

It is another object of the present invention to provide a coin reception mechanism which comprises a coin chute defined by separable members which may be separated from each other through a user actuateable lever so that a user may remove any odd matter and/or debris that is located in and thus blocking off the coin slot to resume the operability of the coin reception mechanism.

In accordance with the present invention, there is provided a coin reception mechanism comprising a base fixed inside for example a pay phone to receive coins for operating the pay phone. The coin reception mechanism comprises a chute assembly comprising a first plate and a second plate which are independent of each other and are both pivoted to the base in such a manner to form a spacing therebetween defining a coin chute leading to a coin collector container. The first plate has a coin slot formed thereon to be substantially in alignment with the coin chute for receiving and guiding a coin into the coin chute. An actuator is pivoted to the base and has two driving arms in contact engagement with the first plate and a link connecting to the second plate so that when the actuator is rotated to drive the first and second plates with respect to the base, the first plate is rotated by the arms of the actuator through a first angular displacement and the second plate is rotated by the link through a second angular displacement which is greater than the first angular displacement so that the first plate is angularly displaced from the second plate to define an opening therebetween for removing an odd matter located in the coin chute out of the chute. A user actuateable lever is provided to rotate the actuator by the user for removal of the odd matter.

BRIEF DESCRIPTION OF THE DRAWINGS

The present invention will be better understood from the following description of a preferred embodiment thereof, with reference to the attached drawings, wherein:

FIG. 4 is a cross-sectional view showing the coin chute that a coin inserted into the reception mechanism moves through;

DETAILED DESCRIPTION OF THE PREFERRED EMBODIMENT

Figure 1:
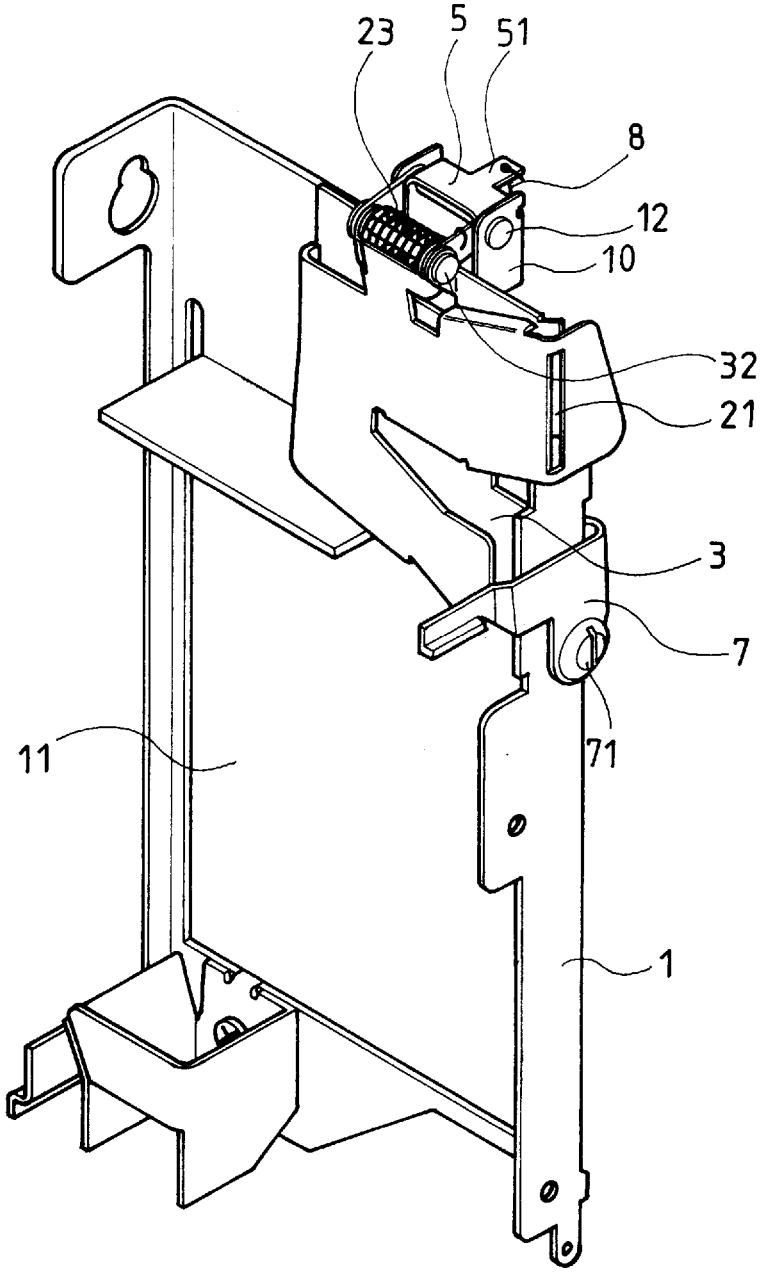
FIG. 1 is a perspective view showing a coin reception mechanism in accordance with the present invention.
Figure 2:
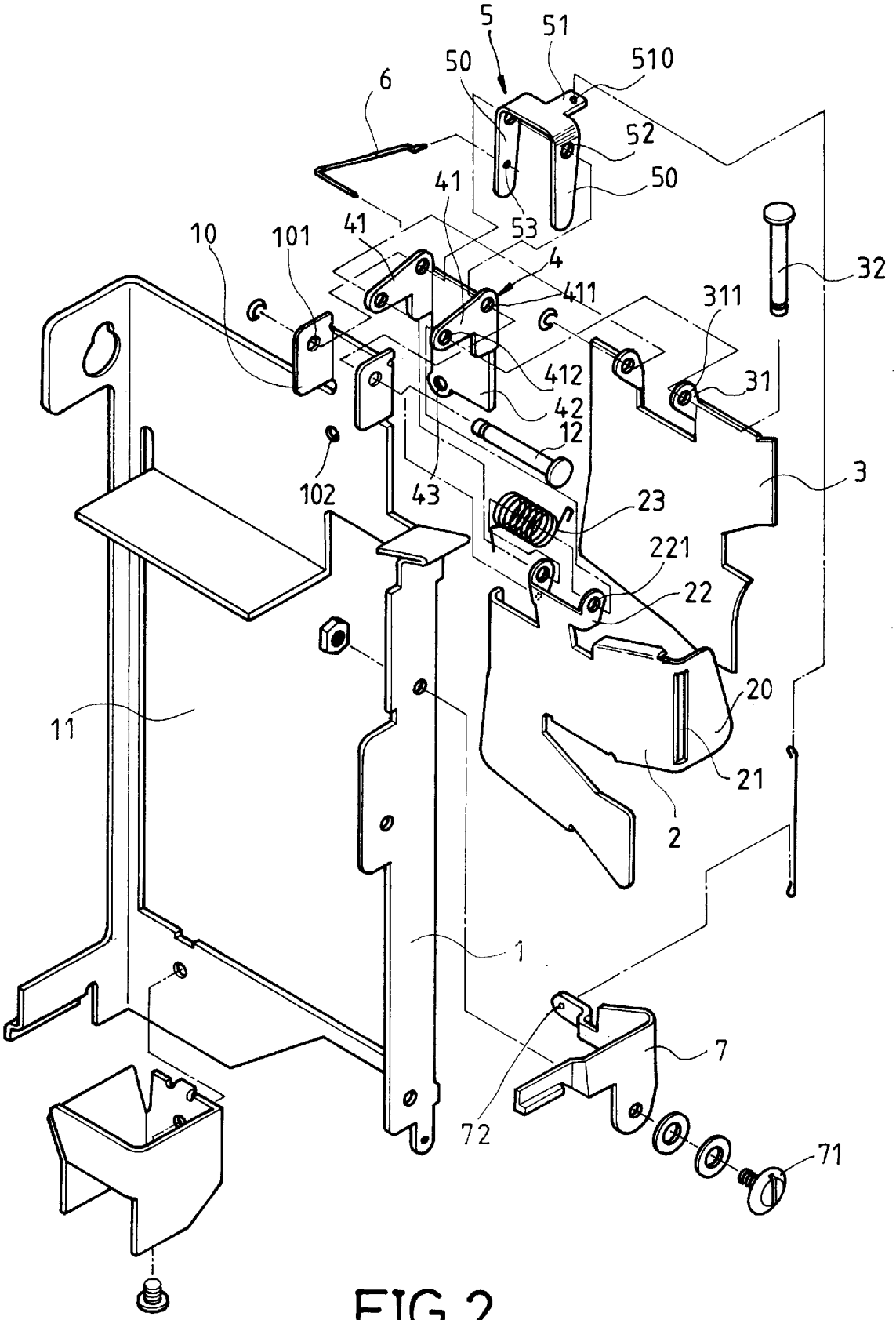
FIG. 2 is an exploded elevational view of the coin reception mechanism in accordance with the present invention.

With reference to the drawings and in particular to FIGS. 1 and 2, wherein a coin reception mechanism constructed in accordance with the present invention is shown, the coin reception mechanism is particularly suitable for use in a pay phone, a video game machine, a slot machine and the like. The coin reception mechanism of the present invention comprises a base 1, preferably made of stainless steel plate, having an opening 11 for receiving and connecting to other parts of for example a pay phone (not shown) is fixed inside the pay phone.

The base 1 comprises a chute assembly holder defined by two spaced and opposite lugs 10 to which a coin chute assembly is pivoted. The coin chute assembly comprises an inner plate 3 and an outer plate 2 substantially opposite to and spaced from each other to define therebetween a spacing, see FIG. 5. One of the inner and outer plates 3 and 2 comprises a plurality of transverse tabs, see FIGS. 4–6 to define a path to be followed by a coin B (FIG. 4) received. In the embodiment illustrated, the transverse tabs, designated at 201, are provided on the outer plate 2 and extending toward the inner plate 3 and are dimensioned to space the outer plate 2 from the inner plate 3 sufficient to allow the coin B to pass through.

The outer plate 2 is provided with an end extension 20, substantially extending in the same direction as the transverse tabs 201, on which a coin slot 21 is formed to be substantially in alignment with the coin chute defined by the transverse tabs 201.

Figure 3:
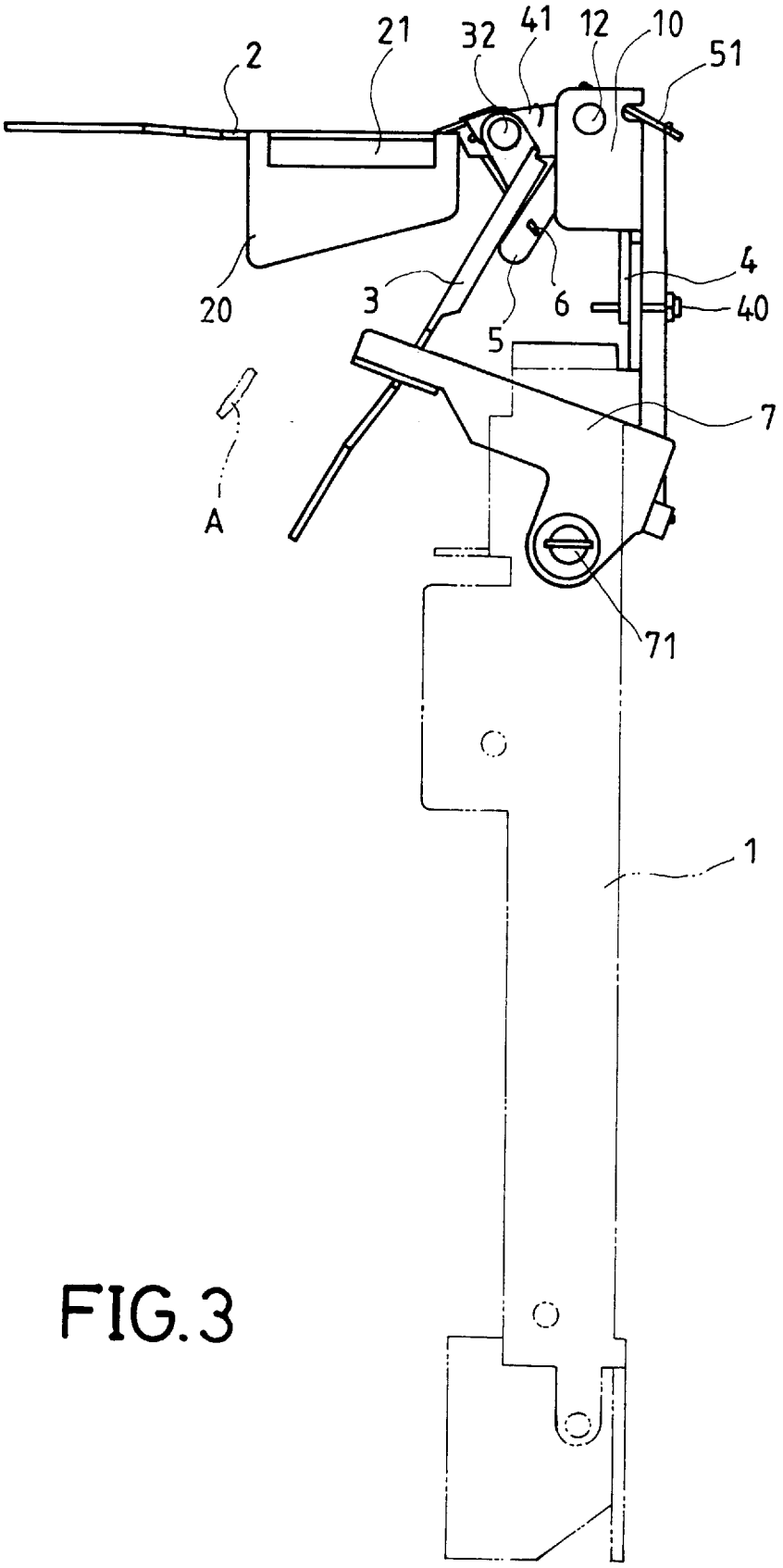
FIG. 3 is a side elevational view showing the operation of the coin reception mechanism of the present invention in removing an odd matter inserted therein.
Figure 4:
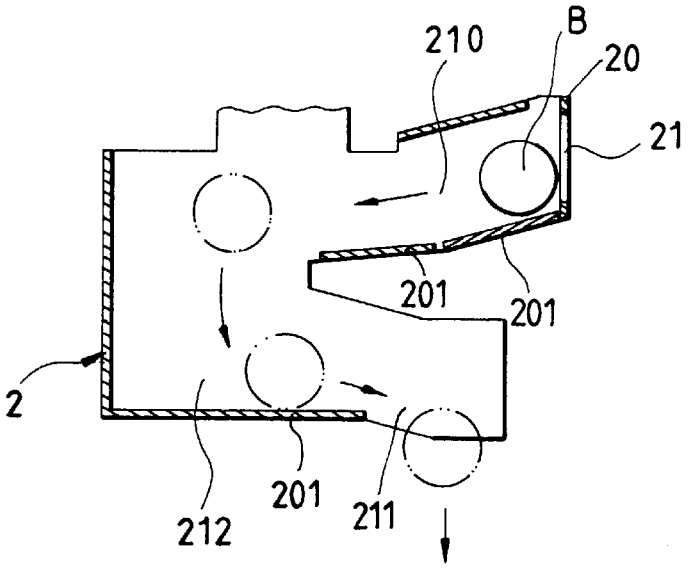

The transverse tabs 201 are arranged to define a substantially U-shaped path, see FIG. 4, having a first section 210 extending substantially horizontally from the coin slot 21 and a lower section 211 extending substantially horizontally and leading to a coin collector container (not shown). The first section 210 is connected to the second section 211 by means of a connecting section 212 which extend substantially vertically to define the U shape. The U-shaped configuration is helpful in blocking an odd matter, designated at A (FIG. 3), while allowing the coin B to move therethrough to the coin collector container. The coin B, which is in generally circular in shape, rolls and follows the U-shaped path to get into the coin collector container. In this respect, both the first and second sections 211 and 212 of the coin chute are preferably slightly inclined downward.

Figure 6:
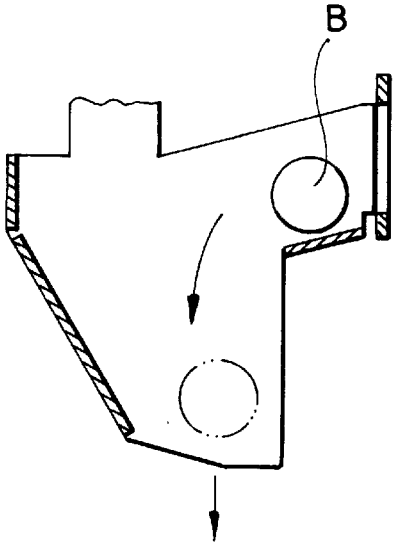
FIG. 6 PRIOR ART
FIG. 6 is a cross-sectional view showing the way that the coin moves through adapted in the prior art.

As compared to the prior art design of the coin chute shown in FIG. 6, the coin B is guided to move directly downward to the coin collector container (not shown in FIG. 6), the U-shaped configuration of the coin chute of the present invention described above is more effectively to prevent the odd matter A from entering the coin collector container.

The lugs 10 of the base 1 comprise pivot holes 101 substantially in alignment with each other. A connector member 4 is fixed between the two lugs 10 and having two arms 41 extending therefrom. Each of the arms 41 has a pivot hole 412.

The inner plate 3 has a pair of spaced lugs 31 each having a pivot hole 311 formed thereon. The outer plate 2 also has a pair of spaced lugs 22 each having a pivot hole 221 formed thereon. The lugs 22 of the outer plate 2 and the lugs 31 of the inner plate 3 are arranged and dimensioned so that in the embodiment illustrated, the lugs 31 of the inner plate 3 are fit over the arms 41 of the connector member 4 and the lugs 22 fit into the arms 41 of the connector member 4. Namely, each of the arms 41 is interposed between the respective lugs 31 and 22 of the inner plate 3 and outer plate 2. A pivot pin 32 extends through all the pivot holes 311, 221 and 412 of the inner plate 3, the outer plate 2 and the arms 41 of the connector member 4 to allow both the inner plate 3 and the outer plate 2 to rotate about the pivot pin 32.

Figure 5:
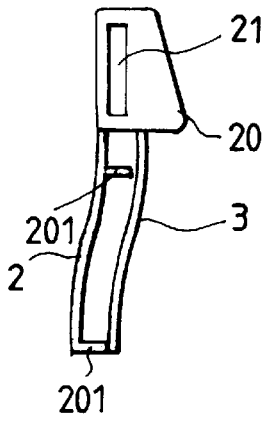
FIG. 5 is a view taken along line 5—5 of FIG. 4.

Preferably, the lugs 22 of the outer plate 2 and the lugs 31 of the inner plate 3 are configured and dimensioned to have the outer plate 2 and the inner plate 3 substantially parallel with each other so that the coin chute defined therebetween is substantially uniform in width, see FIG. 5.

The connector member 4 may be fixed to the base 1 by any known means and arrangement. In the embodiment illustrated, the connector member 4 comprises a second pivot hole 411 formed on each of the arms 41 and opposite to each other. The connector member 4 is so dimensioned and configured to fit into between the lugs 10 of the base 1 that define the chute assembly holder with a second pivot pin 12 extending through the pivot holes 101 of the lugs 10 and the second pivot holes 411 of the connector member 4. The connector member 4 also comprises a downward extension 42 which abuts against the base 1 when the connector member 4 is fixed to the base 1 by the second pivot pin 12. The abutting engagement between the connector member 4 and the base 1 prevents the connector member 4 from rotating relative to the base 1. In addition, a bolt hole 43 may be provided on the downward extension 42 of the connector member 4 and a corresponding bolt hole 102 is provided on the base 1 to allow a bolt or a screw (not shown) extending therethrough to fixedly secure the connector member 4 to the base 1.

An actuator member 5 pivoted to the base 1 by means of the second pivot pin 12 and having chute assembly driving means engageable with the chute assembly so that when the actuator member 5 is driven to rotate about the pivot 12, the engagement between the chute assembly and the chute assembly driving means drives the chute assembly to rotate about the pivot 12 in such a manner to have the outer plate 2 to rotate through an angular displacement greater than that of the inner plate 3, thus separating the outer plate 2 from the inner plate 3 to allow the odd matter A to get out of the chute assembly, see FIG. 3.

In the embodiment illustrated, the actuator member 5 comprises two driving arms 50 that are opposite to and spaced from each other to define first portion of the chute assembly driving means. The two driving arms 50 are connected to each other to define a U shape which is fit into between the arms 41 of the connector member 4 to be located between the inner plate 2 and the base 1. The driving arms 50 have pivot holes 52 formed thereon and corresponding to the second pivot holes 411 of the connector member 4 to allow the second pivot pin 12 extending therethrough to pivot the actuator member 5 to the base 1. The pivotal connection between the actuator member 5 and the base 1 allows free ends of the driving arms 50 to rotate the pivot pin 12.

The driving arms 50 of the actuator member 5 are in contact engagement with the inner plate 3, preferably by means of biasing means, such as a spring 23. The biasing means 23 biases the outer plate 2 toward the driving arms 50 so as to force the inner plate 3 toward the driving arms 50 by means of the contact engagement between the transverse tabs 201 of the outer plate 2 and the inner plate 3. Rotating the actuator member 5 relative to the base 1 against the biasing means 23 forces the chute assembly (the inner plate 3 and the outer plate 2) to move away from the base 1.

A link 6 that constitute a second portion of the chute assembly driving means is pivotally connected between one of the driving arms 50 of the actuator member 5 and the outer plate 2 in such a manner that the rotation of the driving arms 50 that rotates the inner plate 3 through a first angular displacement by means of the contact engagement between the free ends of the driving arms 50 and the inner plate 3 rotates the outer plate 2 through a second angular displacement which is greater than the first angular displacement by means of the pivotal connection of the link 6. Thus, actuating the chute assembly with the actuator member 5 causes the first and second displacements on the inner and outer plates 3 and 2 so as to open the outer plate 2 from the inner plate 3 as shown in FIG. 3. This allows the odd matter A to get out of the chute defined between the outer and inner plates 2 and 3 and fall into for example a debris collector (not shown) due to the gravity thereof.

A user actuateable lever 7 is pivoted to the base 1 by means of for example a bolt 71. The lever 7 has a hole 72 to which an end of a link 8 is connected. The link 8 has an opposite end connecting to a hole 510 formed on an extension 51 of the actuator member 5 so that by rotating the user actuateable lever 7, the link 8 is driven to rotate the actuator member 5 and thus opening the chute assembly as described above. The user actuateable lever 7 may be arranged to be accessible either directly or indirectly by a user to remove the odd matter A from the coin chute defined between the outer plate 2 and the inner plate 3.

Although a preferred embodiment has been described to illustrate the present invention, it is apparent that changes and modifications in the specifically described embodiment can be carried out without departing from the scope of the invention which is intended to be limited only by the appended claims.

What is claimed is:

1. A coin reception mechanism comprising a base adapted to fix inside a device using the coin reception mechanism to receive coin for operating the device, a chute assembly comprising a first plate and a second plate which are independent of each other and are both pivoted to the base in such a manner to form a spacing therebetween defining a coin chute, the first plate having a coin slot formed thereon to be substantially in alignment with the coin chute for receiving and guiding a coin into the coin chute and an actuator pivoted to the base and having first driving means in engagement with the first plate, wherein the first driving means of the actuator comprises at least one driving arm having a free end in contact engagement with the first plate, and second driving means in engagement with the second plate so that when the actuator is rotated to drive the first and second plates with respect to the base with the first and second driving means, the first plate is rotated about the pivot thereof with the base through a first angular displacement and the second plate is rotated about the pivot thereof with the base through a second angular displacement, the second angular displacement being different from the first angular displacement so that the first plate is angularly displaced from the second plate to define an opening therebetween for removing an odd matter located in the coin chute out of the chute.

2. The coin reception mechanism as claimed in claim 1, wherein the second driving means of the actuator comprises a link connecting between the at least one driving arm of the actuator and the second plate.

3. The coin reception mechanism as claimed in claim 2, wherein the actuator comprises biasing means to bias the first and second plates toward the driving arm of the actuator so that rotating the actuator in a direction against the biasing means moves the first plate with the contact engagement thereof with the free end of the driving arm.

4. The coin reception mechanism as claimed in claim 3, wherein the biasing means comprises a spring.

5. A coin reception mechanism comprising a base adapted to fix inside a device using the coin reception mechanism to receive coin for operating the device, a chute assembly comprising a first plate and a second plate which are independent of each other and are both pivoted to the base in such a manner to form a spacing therebetween defining a coin chute, the first plate having a coin slot formed thereon to be substantially in alignment with the coin chute for receiving and guiding a coin into the coin chute and an actuator pivoted to the base and having first driving means in engagement with the first plate, and second driving means in engagement with the second plate so that when the actuator is rotated to drive the first and second plates with respect to the base with the first and second driving means, the first plate is rotated about the pivot thereof with the base through a first angular displacement and the second plate is rotated about the pivot thereof with the base through a second angular displacement, the second angular displacement being different from the first angular displacement so that the first plate is angularly displaced from the second plate to define an opening therebetween for removing an odd matter located in the coin chute out of the chute, wherein the base comprises two space and opposite lugs each having a pivot hole, a connector having two arms spaced from and connecting to each other to be fit into and fixed between the lugs of the base, each of the arms of the connector having a pivot hole corresponding to the pivot holes of the lugs of the base, the actuator comprising two spaced arms received between the arms of the connector and each of the arms of the actuator having a pivot hole corresponding to the pivot holes of the connector and the pivot holes of the lugs of the base to allow a pivot pin extending therethrough for pivoting the actuator to the base, each of the arms of the connector comprising a further pivot hole through which a further pivot pin extends to pivot the first and second plates to the connector with the arms of the actuator in contact engagement with the first plate by being acted upon by the biasing means.

* * * * *